United States Patent [19]

Elsener

[11] Patent Number: 4,694,664

[45] Date of Patent: Sep. 22, 1987

[54] EAR ORNAMENTATION

[76] Inventor: Carl Elsener, Uetlibergstrasse 60, CH-8902 Urdorf, Switzerland

[21] Appl. No.: 732,514

[22] Filed: May 9, 1985

[30] Foreign Application Priority Data

May 10, 1984 [CH] Switzerland ..... 2291/84

[51] Int. Cl.[4] ..... A44C 7/00

[52] U.S. Cl. ..... 63/12; 24/160; D11/75; D11/42

[58] Field of Search ..... 63/12, 13, 15.45, 15.5, 63/15.65, 15.7; D3/61; 70/459; D11/40, 41, 42, 88, 87, 43, 86, 75; 24/161

[56] References Cited

U.S. PATENT DOCUMENTS

| | | | |
|---|---|---|---|
| 208,968 | 10/1878 | Dolloff | 63/12 |
| 241,462 | 5/1881 | Washburn | 63/13 |
| 411,509 | 9/1889 | Pike | 63/12 |
| 3,736,770 | 6/1973 | Kelrick | 63/15.7 |
| 4,292,715 | 10/1981 | Huddon | 63/13 |

*Primary Examiner*—Richard J. Johnson

*Attorney, Agent, or Firm*—Thomas W. Speckman; Ann W. Speckman

[57] ABSTRACT

Jewelry designed to be worn on a perforated ear lobe, comprising two ornamental components linked by a hinge. These two components together form an earring. Fastening means are arranged in each component of the jewelry. The ear ornamentation is closed by rotating the two components about the hinge and engaging fastening means located at the opposite end of each component from the hinge. One fastening means comprises a fine gold alloy pin with a recess. Another fastening means comprises a seating into which the pin is pivoted, the recess engaging in a positive snap fit with a projection in the seating. This ear ornamentation is reversible due to the hidden design of the fastening means, is easy to handle and aesthetically pleasing.

9 Claims, 5 Drawing Figures

EAR ORNAMENTATION

BACKGROUND OF THE INVENTION

There are basically two types of jewelry which can be worn on the ears. There is jewelry which is simply clipped to the ear, and there are earrings which are fastened to the ear by means of an attachment which passes through a perforation in the ear lobe.

Jewelry of the latter type is generally fastened by means of a so-called earring pin which can be removed from the ear. This pin is pushed through the perforation and fastened behind the lobe. Ear pendants are also made on the same principle. However, in the case of the pendant, the pin is fitted to a small yoke and the piece of jewelry is permanently mounted on this yoke.

If the yoke is fastened directly to the jewelry by means of movable components, so that the yoke takes the function of the pin and can thus be inserted through the perforated lobe, this arrangement is termed a creole. In this case the yoke fastens firmly into the piece of jewelry to which it is then positively clasped.

Finally, earrings are known which are fitted with releasable fastenings. These fastenings are similar to those used on necklaces and are not integral with the earring itself. A ring-shaped fastening with a sliding latch or clasp is passed through the perforation, while the earring itself is suspended from the actual fastening, just like a pendant.

Unlike earrings fitted with pins, pendants, creoles and ear clips are today considered aesthetically unpleasing. With the exception of ear clips, all the types of fastenings used for these types of jewelry are impractical. When attachments comprising a number of different parts have to be fastened, as in the case of earrings with pins, in particular, parts get lost or, in the case of jewelry fitted with movable components, the latches can jam.

SUMMARY OF THE INVENTION

An object of this invention is to provide a removable piece of jewelry for the ears, which is fastened through a perforation in the ear lobe, and which provides complete aesthetic satisfaction and is easy for the wearer to handle.

This objective is achieved by the provision of a piece of jewelry for the ears in which a distinguishing feature is that it comprises two ornamental components linked together by means of a hinge, whereby fastening means are arranged on each component diametrically opposite relative to the direction of rotation about the hinge. This fastening arrangement is closed simply by rotating the two parts which are then positively clasped together.

When the ear ornamentation is worn, the actual fastening arrangement remains invisible. To the eye, the ear ornamentation appears to be made of one solid piece. The flexible spring pin which is fitted to the piece of jewelry itself, is simply inserted through the perforated ear lobe and the two halves of the ear ornamentation are rotated towards one another until they engage firmly together, forming an integrally clasped whole.

BRIEF DESCRIPTION OF THE DRAWING

The drawing shows embodiments of the ear ornamentation according to this invention, which may be described as follows.

DESCRIPTION OF PREFERRED EMBODIMENTS

Figure 1:
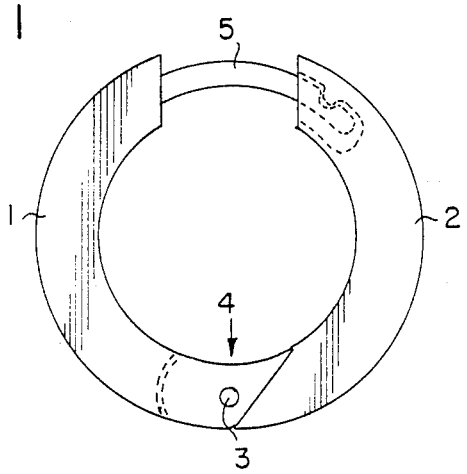
FIG. 1 shows an ear ornamentation according to this invention, in the closed condition.
Figure 2:
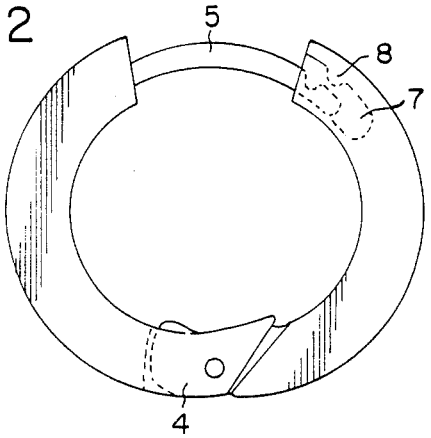
FIG. 2 shows the ear ornamentation of FIG. 1 being opened or closed.
Figure 3:
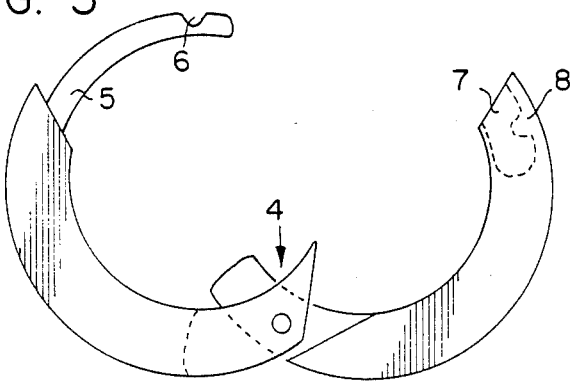
FIG. 3 shows the ear ornamentation of FIG. 1 in the open condition.
Figure 4:
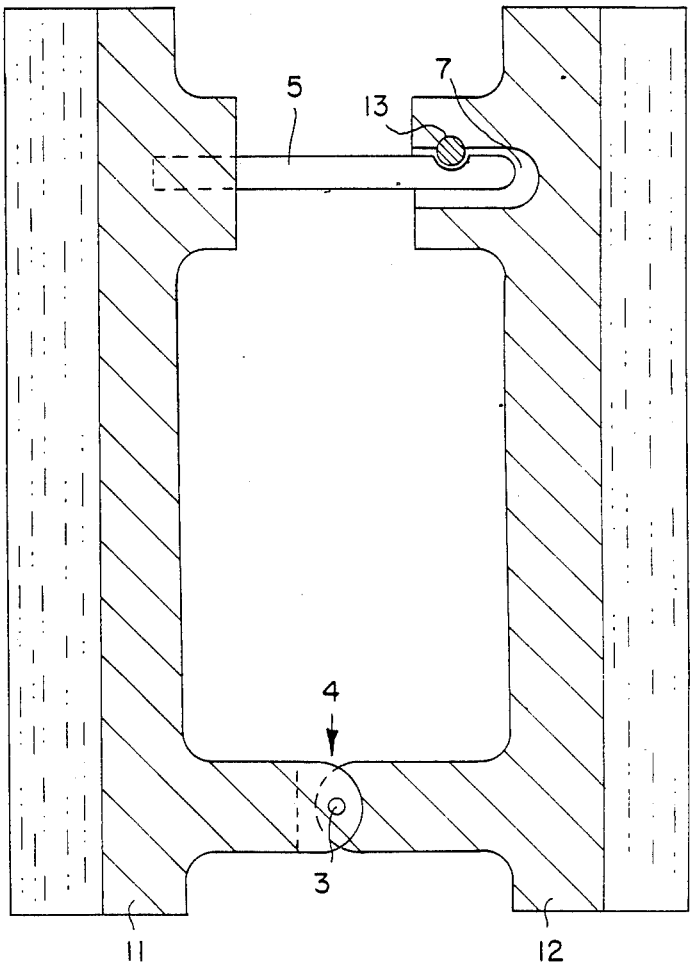
FIG. 4 shows an ear ornamentation according to this invention which resembles an ear clip.
Figure 5:
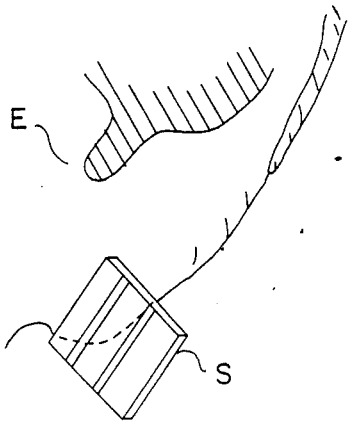
FIG. 5 shows the ear ornamentation of FIG. 4, about life-size, in place on the ear.

In FIGS. 1-3, an ear ornamentation in the form of a ring is illustrated in three different conditions. Although the design according to this invention is particularly suitable for this type of earring, it is by no means limited to this application, as shown in FIGS. 4 and 5.

In all cases, the ear ornamentation comprises two ornamental components which, in the first example, take the form of two ring halves. These two ring halves are linked by hinged pin 3. The configuration of this hinge is not important to the present invention, except that it is important for the hinge to provide a precise means for guiding the rotation of the two pivoting ring halves. Although hinge 4, as seen in the drawing, is visible even when the earring is closed, in reality the hinge is hardly visible when the earring is worn. The earring is fitted with diametrically opposed fastening means attached to each of the components of jewelry. Spring pin 5 with a transverse recess near the end of the pin, is fitted to ring half 1. Pin 5 has the same curved configuration as ring half 1 in which it is retained. The cross section of spring pin 5 may vary, but the recess must be of suitable configuration to match the second ring half.

The second ring half 2 is fitted with receiving aperture 7 in which spring pin 5 is engaged when the earring is closed. As shown in the drawing, this receiving aperture may be a blind hole; however, in the case of a ring configuration, this receiving aperture may take the form of an annular groove or groove section. This arrangement provides the additional advantage of facilitating the fitting of a simple projection 8 as a snap catch.

If the receiving aperture takes the form of a blind hole, the hole must be wide enough to allow spring pin 5 to slide over projection 8 in the blind hole.

When the ring is closed, the length of the exposed part of pin 5 should be approximately the thickness of an ear lobe. For this purpose, the fine gold alloy pin should have an exposed length of about 3–7 mm.

With the type of earring shown in the drawing, the fastening arrangement is invisible when the earring is worn. This means that the earring can be worn in a number of different ways. A further advantage of this arrangement is that each of the rings may have a different shape, since only the outer one is visible on the wearer.

FIGS. 4 and 5 show that the principle of this invention is applicable to forms of ear ornamentation other than rings. In each case, the same reference numbers have been given to the same parts and so their description is not repeated here. Plates 11 and 12 both have ornamental or decorative surfaces, or may serve as settings for stones. These two surfaces are linked to one another by means of hinge 4. Fastening means 5 and 7 are also similarly provided. In this case, the projection is formed by pin 13 arranged transversely to the axis of the receiving aperture 7, and projecting at least partially into the receiving aperture.

FIG. 5 illustrates an elegant ear ornamentation according to this invention. Apart from ear itself E, and outer surfaces of the piece of jewelry S, nothing else is visible.

These two embodiments are by no means exhaustive, although the design principle will be the same in all cases. This will also be the case if a recess is located in receiving aperture 7 for pin 5 instead of the projection.

I claim:

1. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each said ornamental component (1, 2), (11, 12), and opposite each other relative to the direction of rotation about said hinge (4), said engageable fastening means comprising a spring pin (5) mounted in one said ornamental component (1, 11) with a transverse recess (6) near a terminal end of said spring pin (5), and a receiving aperture (7) with a projection (8) therein in the other said ornamental component, said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe.

2. An ear ornamentation according to claim 1, wherein said projection (8) within said receiving aperture (7) is formed by a pin (13) extending transverse to the axis of said receiving aperture (7).

3. An ear ornamentation according to claim 1, wherein said two ornamental components (1, 2), (11, 12) have dissimilar ornamentation.

4. An ear ornamentation according to claim 1, wherein the exposed length of said spring pin (5) is about 3 to about 7 mm.

5. An ear ornamentation according to claim 1, wherein said pin (5) is made of a fine gold alloy.

6. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at other end of each said ornamental component (1, 2), (11, 12), and opposite each other relative to the direction of rotation about said hinge (4), said engageable fastening means comprising a spring pin (5) mounted in one said ornamental component (1, 11) with a projection near a terminal end of said spring pin (5), and a receiving aperture (7) with a recess therein in the other said ornamental component, said recess providing a snap catch for engagement with said projection on said spring pin (5), whereby said two ornamental components (1, 2), 11, 12) are positively and integrally locked by engagement of said fastening means upon rotation of said ornamental components in one direction, and said two ornamental components are opened and said fastening means are disengaged by rotation of said ornamental components in an opposite direction, and said engageable fastening means are invisible when said ear ornamentation is engaged on said perforated ear lobe.

7. An ear ornamentation according to claim 6, wherein the exposed length of said spring pin (5) is about 3 to about 7 mm.

8. An ear ornamentation according to claim 6, wherein said spring pin (5) is made of a fine gold alloy.

9. An ear ornamentation according to claim 6, wherein said two ornamental components (1, 2), (11, 12) have dissimilar ornamentation.

* * * * *

US004694664B1

REEXAMINATION CERTIFICATE (3819th)

United States Patent [19] [11] B1 4,694,664

Elsener [45] Certificate Issued Jul. 27, 1999

[54] EAR ORNAMENTATION

[75] Inventor: Carl Elsener, Urdorf, Switzerland

[73] Assignee: Friedrich Zettl GmbH, Birkenfeld Pforzheim, Germany

Reexamination Request:
No. 90/004,844, Nov. 13, 1997

Reexamination Certificate for:

| | |
|---|---|
| Patent No.: | **4,694,664** |
| Issued: | **Sep. 22, 1987** |
| Appl. No.: | **06/732,514** |
| Filed: | **May 9, 1985** |

[30] Foreign Application Priority Data

May 10, 1984 [CH] Switzerland ..... 2291/84

[51] Int. Cl.[6] ..... A44C 7/00

[52] U.S. Cl. ..... 63/12; D11/42; D11/75

[58] Field of Search ..... 63/12, 13, 15.45, 63/15.5, 15.65, 15.7; 70/459; D11/40, 41, 42, 43, 75, 86, 87, 88

[56] References Cited

U.S. PATENT DOCUMENTS

| | | | |
|---|---|---|---|
| 241,462 | 5/1881 | Wachburn | 63/13 |
| 411,509 | 9/1889 | Pike | 63/12 |
| 3,736,770 | 6/1973 | Kelrick | 63/15.7 |
| 4,114,399 | 9/1978 | Zur | 63/12 |

OTHER PUBLICATIONS

European Jeweler, advertisement of Emil Hasenfratz, Sep. 1982.

*Primary Examiner*—Brian K. Green

[57] ABSTRACT

Jewelry designed to be worn on a perforated ear lobe, comprising two ornamental components linked by a hinge. These two components together form an earring. Fastening means are arranged in each component of the jewelry. The ear ornamentation is closed by rotating the two components about the hinge and engaging fastening means located at the opposite end of each component from the hinge. One fastening means comprises a fine gold alloy pin with a recess. Another fastening means comprises a seating into which the pin is pivoted, the recess engaging in a positive snap fit with a projection in the seating. This ear ornamentation is reversible due to the hidden design of the fastening means, is easy to handle and aesthetically pleasing.

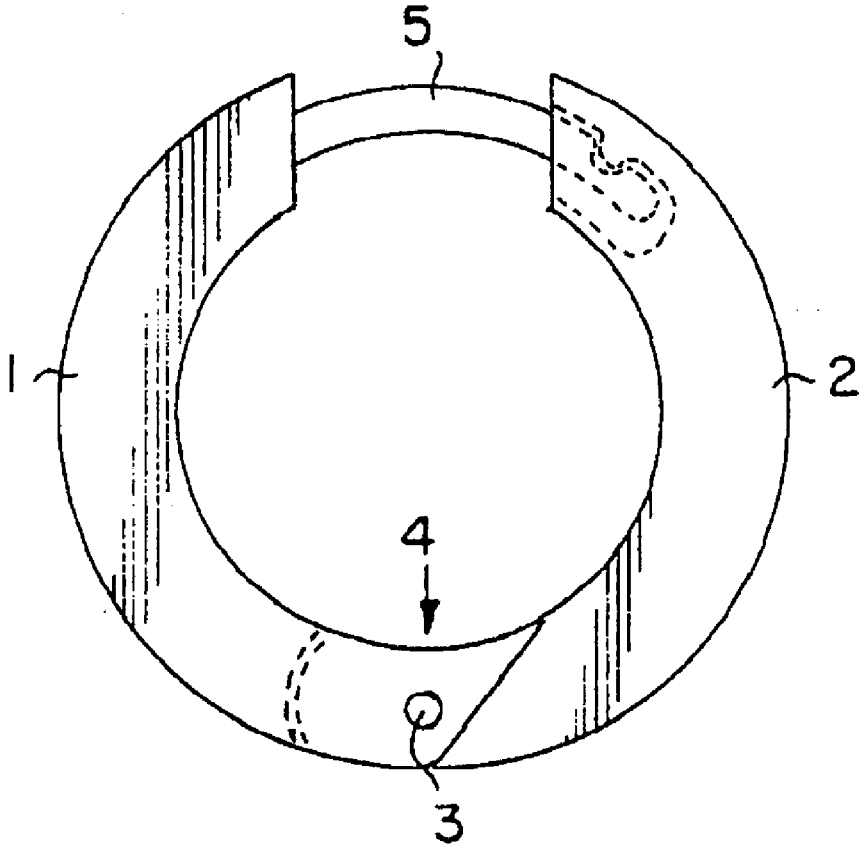

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 3, 5, 6, 8 and 9 is confirmed.

Claims 2, 4 and 7 are determined to be patentable as amended.

New claims 10–23 are added and determined to be patentable.

2. An ear ornamentation [according to claim 1,] *for wearing on and removable from a perforated each lobe comprising two ornamental components (1, 2), (11, 12) of substantially the same size and configuration linked by means of a hinge (4) at one end and having engageable fastening means (5, 6, 7 and 8) at the other end of each said ornamental component (1, 2), (11, 12), and opposite each other relative to the direction of rotation about said hinge (4), said engageable fastening means comprising a spring pin (5) mounted in one said ornamental component (1, 11) with a transverse recess (6) near a terminal end of said spring pin (5), and a receiving aperture (7) with a projection (8) therein in the other said ornamental component,* wherein said projection (8) within said receiving aperture (7) is formed by a pin (13) extending transverse to the axis of said receiving aperture (7), *said projection (8) providing a snap catch for engagement with said transverse recess (6)* in said spring pin (5), *whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe.*

4. An ear ornamentation [according to claim 1,] *for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each said ornamental component (1, 2), (11, 12), and opposite each other relative to the direction of rotation about said hinge (4), said engageable fastening means comprising a spring pin (5) mounted in one said ornamental component (1, 11) with a transverse recess (6) near a terminal end of said spring pin (5), and a receiving aperture (7) with a projection (8) therein in the other said ornamental component, said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe,* wherein the exposed length of said spring pin (5) is about 3 to about 7 mm.

7. An ear ornamentation [according to claim 6,] *for wearing on and removable from a perforated ear lobe comprising two ornamental components (1, 2), (11, 12) of substaintially the same size and configuration linked by means of a hinge (4) at one end and having engageable fastening means (5, 6, 7 and 8) at another end of each of said ornamental components (1, 2), (11, 12), said other end of each of said ornamental components being free of dependent arms which are visible when the ear ornament is engaged on said perforated ear lobe, said fastening means being opposite each other relative to the direction of rotation about the said hinge (4), said engageable fastening means comprising a spring pin (5) mounted in one of said ornamental components (1, 11) with a projection near a terminal end of said spring pin (5),* [wherein] the exposed length of said spring pin (5) [is] *being* about 3 to about 7 mm, *and a receiving aperture (7) with a recess therein in the other of said ornamental components, said recess providing a snap catch for engagement with said projection on said spring pin (5), whereby said two ornamental components (1, 2), (11, 12) are positively and integrally locked by engagement of said fastening means upon rotation of said ornamental components in one direction, and said two ornamental components are opened and said fastening means are disengaged by rotation of said ornamental components in an opposite direction, said spring pin (5) being curved to form an arc corresponding to a path followed by said other ends of said ornamental components during the rotation of said ornamental components about said hinge, and said engageable fastening means are invisible when said ear ornamentation is engaged on said perforated ear lobe.*

*10. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), said other end of each of said ornamental components being free of dependent arms which are visible when the ear ornament is engaged on said perforated ear lobe, said fastening means being opposite each other relative to a direction of rotation about said hinge (4), said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said projection (8) providing a snap catch for engagement with said transverse recess (6) in said spring pin (5) whereby said two ornamental components (1, 2), (11, 12) are positively and integrally locked by engagement of said fastening means upon rotation of said two ornamental components in one direction, said spring pin (5) having an end which enters said aperture and does not protrude from said other of said ornamental components when locked, and said two ornamental components are opened and said fastening means disengaged by rotation of said ornamental components in an opposite direction, and said engageable fastening means are invisible when said ear ornamentation is engaged on said perforated ear lobe.*

*11. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), and opposite each other relative to the direction of rotation about said hinge (4), said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe, said spring pin being curved to form an arc corresponding to a path which said other end of each of said ornamental components follows upon said rotation of said ornamental components about said hinge.*

*12. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), and opposite each other relative to the direction of rotation about said hinge (4), said engageable fastening means comprising a spring pin (5) mounted in one of said ornamental components (1,11) with a transverse recess (6) near a terminal end of said spring pin (5), and a receiving aperture (7) with a projection (8) therein in the other of said ornamental components, said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe, said aperture being an orifice of a mouth of a blind hole in said ornamental component.*

*13. An ear ornament according to one of the claims 1, 6 or 10 wherein said aperture is selected from a group consisting of an opening, hole, gap, crack, cleft, chasm, slit, groove, or groove section.*

*14. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), and opposite each other relative to the direction of rotation about said hinge (4), said two ornamental components (1,2), (11, 12) having dissimilar ornamentations, said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said aperture being selected from a group consisting of an opening, hole, gap, crack, cleft, chasm, slit, groove or groove section, said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, said spring pin being curved to form an arc corresponding to a path which said other ends of each of said ornamental components follow upon said rotation of said ornamental components about said hinge, and said engageable fastening means are invisible when said ear ornamentation is engaged on said perforated ear lobe.*

*15. An ear ornamentation for wearing on and removable from a perforated ear lobe comprising two ornamental components (1, 2), (11, 12) of substantially the same size and configuration linked by means of a hinge (4) at one end and near a bottom of each of said ornamental components and having engageable fastening means (5, 6, 7 and 8) at the other end and near a top of each of said ornamental components (1, 2), (11, 12), said fastening means having an element on each of said ornamental components at locations opposite each other relative to a direction of rotation about said hinge (4), said engageable fastening means comprising a spring pin (5) extending directly from one of said ornamental components (1, 11) near said top thereof with a transverse recess (6) near a terminal end of said spring pin (5), and a receiving aperture (7) with a projection (8) therein formed directly in the other of said ornamental components and near the top thereof, said aperture being selected from a group consisting of an opening, hole, gap, crack, cleft, chasm, slit, groove or groove section; said projection (8) providing a snap catch for engagement with said transverse recess (6) in said spring pin (5), whereby said two ornamental components (1, 2), (11, 12) are positively and integrally locked by engagement of said fastening means upon rotation of said two ornamental components in one direction, said spring pin (5) having an end which enters said aperture and does not protrude from said other of said ornamental components when locked, and said two ornamental components are opened and said fastening means disengaged by rotation of said ornamental components in an opposite direction, said fastening means being shaped so that said ear ornamentation will hang on said perforated ear lobe from near said top of said ornamental components and said engageable fastening means being invisible when said ear ornamentation is engaged on said perforated ear lobe.*

*16. An ear ornamentation for wearing on and removable from a perforated ear lobe comprising two ornamental components (1, 2), (11, 12) of substantially the same size and configuraiton linkd by means of a hinge (4) at one end and having engageable fastening means (5, 6, 7 and 8) at another end of each of said ornamental components (1, 2), (11, 12), said other end of each of said ornamental components being free of dependent arms which are visible when the ear ornamentation is engaged on said perforated ear*

*lobe, said fastening means being opposite each other relative to the direction of rotation about said hinge (4), said engageable fastening means comprising a spring pin (5) mounted in one of said ornamental components (1, 11) with a projection near a terminal end of said spring pin (5), and a receiving aperture (7) with a recess therein in the other of said ornamental components, said recess providing a snap catch for engagement with said projection on said spring pin (5), whereby said two ornamental components (1, 2), (11, 12) are positively and integrally locked by engagement of said fastening means upon rotation of said ornamental components in one direction, and said two ornamental compnents are opened and said fastening means are disengaged by rotation of said ornamental components in an opposite direction, said spring pin being curved to form an arc corresponding to a path which said other end of each of said ornamental components follows upon said rotation of said ornamental components about said hinge, and said engageable fastening means are invisible when said ear ornamentation is engaged on said perforated ear lobe.*

*17. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), said other end of each of said ornamental components being free of dependent arms which are visible when the ear ornament is engaged on said perforated ear lobe, said fastening means being opposite each other relative to a direction of rotation about said hinge (4), said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said projection (8) providing a snap catch for engagement with said transverse recess (6) in said spring pin (5) whereby said two ornamental components (1, 2), (11, 12) are positively and integrally locked by engagement of said fastening means upon rotation of said two ornamental components in one direction, said spring pin (5) having an end which enters said aperture and does not protrude from said other of said ornamental components when locked, and said two ornamental components in an opposite direction, said spring pin being curved to form an arc corresponding to a path which said other end of each of said ornamental components follows upon said rotation of said ornamental components about said hinge, and said engageable fastening means are invisible when said ear ornamentation is engaged on said perforated ear lobe.*

*18. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at another end of each of said ornamental components (1, 2), (11, 12), said other end of each of said ornamental components being free of dependent arms which are visible when the ear ornamentation is engaged on said perforated ear lobe, and fastening means being opposite each other relative to a direction of rotation about said hinge (4), said engageable fastening means comprising a spring pin (5) mounted in one of said ornamental components (1, 11) with a projection near a terminal end of said spring pin (5), and a receiving aperture (7) with a recess therein in the other of said ornamental components, said aperture being an orifice at a mouth of a blind hole in said ornamental component, said recess providing a snap catch for engagement with said projection on said spring pin (5), whereby said two ornamental components (1, 2), (11, 12) are positively and integrally locked by engagement of said fastening means upon rotation of said ornamental components in one direction, and said two ornamental components are opened and said fastening means are disengaged by rotation of said ornamental components in an opposite direction, and said engageable fastening means are invisible when said ear ornamentation is engaged on said perforated ear lobe.*

*19. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), said other end of each of said ornamental components being free of dependent arms which are visible when the ear ornament is engaged on said perforated ear lobe, said fastening means being opposite each other relative to a direction of rotation about said hinge (4), said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said aperture being an orifice at a mouth of a blind hole in said ornamental component, said projection (8) providing a snap catch for engagement with said transverse recess (6) in said spring pin (5) whereby said two ornamental components (1, 2), (11, 12) are positively and integrally locked by engagement of said fastening means upon rotation of said two ornamental components in one direction, said spring pin (5) having an end which enters said aperture and does not protrude from said other of said ornamental components when locked, and said two ornamental components are opened and said fastening means disengaged by rotation of said ornamental components in an opposite direction, and said engageable fastening means are invisible when said ear ornamentation is engaged on said perforated ear lobe.*

*20. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at another end of each of said ornamental components (1, 2), (11, 12), said other end of each of said ornamental components being free of dependent arms which are visible when the ear ornamentation is engaged on said perforated ear lobe, said fastening means being opposite each other relative to a direction of rotation about said hinge (4), said engageable fastening means comprising a spring pin (5) mounted in one of said ornamental components (1, 11) with a projection near a terminal end of said spring pin (5), and a receiving aperture (7) with a recess therein in the other of said ornamental components and aperture being selected from a group consisting of an opening, hole, gap, crack, cleft, chasm, slit, groove, or groove section, said recess providing a snap catch for engagement with said projection on said spring pin (5), whereby said two ornamental components (1, 2), (11, 12) are positively and integrally locked by engagement of said fastening means upon rotation of said*

*ornamental components in one direction, and said two ornamental components are opened and said fastening means are disengaged by rotation of said ornamental components in an opposite direction, said spring pin being curved to form an arc corresponding to a path which said other end of each of said ornamental components follow upon said rotation of said ornamental components about said hinge, and said engageable fastening means are invisible when said ear ornamentation is engaged on said perforated ear lobe.*

*21. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), said other end of each of said ornamental components being free of dependent arms which are visible when the ear ornament is engaged on said perforated ear lobe, said fastening means being opposite each other relative to a direction of rotation about said hinge (4), said engageable fastening means comprising a spring pin (5) mounted in one of said ornamental components (1, 11) with a transverse recess (6) near a terminal end of said spring pin (5), and a receiving aperture (7) with a projection (8) therein in the other of said ornamental components, said aperture being selected from a group consisting of an opening, hole, gap, crack, cleft, chasm, slit, groove, or groove section, said projection (8) providing a snap catch for engagement with said transverse recess (6) in said spring pin (5) whereby said two ornamental components (1, 2), (11, 12) are positively and integrally locked by engagement of said fastening means upon rotation of said two ornamental components in one direction, said spring pin (5) having an end which enters said aperture and does not protrude from said other of said ornamental components when locked, and said two ornamental components are opened and said fastening means disengaged by rotation of said ornamental components in an opposite direction, said spring pin being curved to form an arc corresponding to a path which said other end of each of said ornamental components follow upon said rotation of said ornamental components about said hinge and said engageable fastening means are invisible when said ear ornamentation is engaged on said perforated ear lobe.*

*22. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at the other end of each of said ornamental components (1, 2), (11, 12), and opposite each other relative to a direction of rotation about said hinge (4), said engageable fastening means comprising a spring pin (5) mounted in one of said ornamental components (1, 11) with a transverse recess (6) near terminal end of said spring pin (5), and a receiving aperture (7) with a projection (8) therein in the other of said ornamental components said projection (8) providing a snap catch for engagement with said transverse recess (6) in said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, said engageable fastening means being invisible when said ear ornamentation is engaged on said perforated ear lobe, the exposed length of said spring pin (5) being about 3 to about 7 mm. and said spring pin (5) being curved to form an arc corresponding to a path followed by said other ends of said ornamental components during the rotation of said ornamental components about said hinge.*

*23. An ear ornamentation for wearing on and removable from a perforated ear lobe comprising two ornamental components (1, 2), (11, 12) of substantially the same size and configuration linked by means of a hinge (4) at one end and having engageable fastening means (5, 6, 7 and 8) at another end of each of said ornamental components (1, 2), (11, 12), said other end of each of said ornamental components being free of dependent arms which are visible when the ear ornament is engaged on said perforated ear lobe, said fastening means being opposite each other relative to the direction of rotation about said hinge (4), said engageable fastening means comprising a spring pin (5) mounted in one of said ornamental components (1, 11) with a projection near a terminal end of said spring pin (5), and a receiving aperture (7) with a recess therein in the other of said ornamental components, said recess providing a snap catch for engagement with said projection on said spring pin (5), whereby said two ornamental components (1, 2), (11, 12) are positively and integrally locked by engagement of said fastening means upon rotation of said ornamental components in one direction, and said two ornamental components are opened and said fastening means disengaged by rotation of said ornamental components in an opposite direction, and said engageable fastening means are invisible when said ear ornamentation is engaged on said perforated ear lobe.*

* * * * *